US010036582B2

(12) United States Patent
Thornton et al.

(10) Patent No.: US 10,036,582 B2
(45) Date of Patent: Jul. 31, 2018

(54) COMPRESSOR WITH ROTOR COOLING PASSAGEWAY

(71) Applicant: DANFOSS A/S, Nordborg (DK)

(72) Inventors: William Turner Thornton, Winter Haven, FL (US); Joost Brasz, Fayetteville, NY (US)

(73) Assignee: DANFOSS A/S (DK)

( * ) Notice: Subject to any disclaimer, the term of this patent is extended or adjusted under 35 U.S.C. 154(b) by 464 days.

(21) Appl. No.: 14/898,312

(22) PCT Filed: Jun. 12, 2013

(86) PCT No.: PCT/US2013/045391

§ 371 (c)(1),
(2) Date: Dec. 14, 2015

(87) PCT Pub. No.: WO2014/200476

PCT Pub. Date: Dec. 18, 2014

(65) Prior Publication Data

US 2016/0138841 A1 May 19, 2016

(51) Int. Cl.

| | |
|---|---|
| ***F25B 31/00*** | (2006.01) |
| ***F25B 31/02*** | (2006.01) |
| ***F25B 1/053*** | (2006.01) |
| ***F25B 49/02*** | (2006.01) |
| ***F04D 29/58*** | (2006.01) |

(52) U.S. Cl.

CPC ..... *F25B 31/006* (2013.01); *F04D 29/5806* (2013.01); *F25B 1/053* (2013.01); *F25B 31/026* (2013.01); *F25B 49/02* (2013.01); *F25B 2600/2515* (2013.01); *F25B 2700/21157* (2013.01)

(58) Field of Classification Search

CPC .... F04D 25/064; F04D 25/082; F04D 29/083; F04D 29/102; F04D 29/5806; F25B 1/053; F25B 31/026; F25B 31/006; F25B 49/02; F25B 2600/2515; F25B 2700/21157; H02K 1/20; H02K 1/30; H02K 5/10; H02K 5/12; H02K 5/20; H02K 9/00; H02K 9/005; H02K 9/19; H02K 9/193; H02K 9/197; H02K 9/20; H02K 2209/00; H02K 1/32

USPC ..... 310/12.29, 52

See application file for complete search history.

(56) References Cited

U.S. PATENT DOCUMENTS 2,887,062 A * 5/1959 Cametti ..... F04D 7/06 310/54
3,085,809 A * 4/1963 Cooper ..... F16J 15/445 277/415

(Continued)

OTHER PUBLICATIONS

International Preliminary Report for International Application No. PCT/US2013/045391 dated Dec. 23, 2015.

*Primary Examiner* — Peter J Bertheaud
*Assistant Examiner* — Joseph Herrmann
(74) *Attorney, Agent, or Firm* — Carlson, Gaskey & Olds, P.C.

(57) ABSTRACT

A centrifugal compressor for a refrigeration system is disclosed. The centrifugal compressor includes an electric motor, which includes a rotor and a stator. The compressor further includes a housing enclosing the electric motor, a stator cooling passage provided within the housing, and a rotor cooling passageway provided within the housing. The rotor cooling passageway is independent of the stator cooling passageway.

15 Claims, 3 Drawing Sheets

(56) References Cited

U.S. PATENT DOCUMENTS

| | | | | |
|---|---|---|---|---|
| 3,362,624 | A | 1/1968 | Endress | |
| 3,475,631 | A * | 10/1969 | Bollibon | H02K 5/128 310/54 |
| 4,903,497 | A | 2/1990 | Zimmern et al. | |
| 5,616,973 | A * | 4/1997 | Khazanov | H02K 5/20 310/54 |
| 6,065,297 | A | 5/2000 | Tischer et al. | |
| 7,160,086 | B2 * | 1/2007 | Maceyka | H02K 9/06 310/63 |
| 7,240,515 | B2 | 7/2007 | Conry | |
| 7,745,965 | B2 * | 6/2010 | Oestreich | H02K 5/20 310/52 |
| 8,021,127 | B2 | 9/2011 | De Larminat | |
| 8,523,540 | B2 * | 9/2013 | Eide | F04D 29/586 310/52 |
| 9,291,166 | B2 * | 3/2016 | De Larminat | F04D 25/082 |
| 2010/0006264 | A1 | 1/2010 | Jadric et al. | |
| 2012/0017617 | A1 | 1/2012 | Beers et al. | |
| 2013/0230382 | A1 * | 9/2013 | De Larminat | F04D 25/082 415/1 |

* cited by examiner

COMPRESSOR WITH ROTOR COOLING PASSAGEWAY

BACKGROUND

This disclosure relates to cooling of a motor for a centrifugal compressor of a refrigeration system. Centrifugal refrigerant compressors are known, and include one or more impellers driven by a motor. The motor in some examples is an electric motor including a rotor and a stator. In one known example the motor is cooled by circulating refrigerant about the stator, to cool the stator, and then directing that refrigerant between the rotor and the stator to cool the rotor. After cooling the rotor, the refrigerant is returned to a refrigeration loop.

SUMMARY

One exemplary embodiment of this disclosure includes a centrifugal compressor for a refrigeration system having an electric motor, which includes a rotor and a stator. The compressor further includes a housing enclosing the electric motor, a stator cooling passageway provided within the housing, and a rotor cooling passageway provided within the housing. The rotor cooling passageway is independent of the stator cooling passageway.

Another exemplary embodiment of this disclosure includes a centrifugal compressor for a refrigeration system including an impeller, and an electric motor including a rotor and a stator. The electric motor is configured to rotationally drive the impeller via a shaft, and the impeller is separated from the electric motor by a seal. The compressor further includes a housing enclosing the electric motor. A rotor cooling passageway is provided within the housing, and is configured to provide a flow of fluid to cool the rotor. The rotor cooling passageway is provided with a flow of fluid leaked over the seal.

A further exemplary embodiment of this disclosure includes a refrigeration system having a refrigerant loop including a condenser, an evaporator, and an expansion device. The refrigeration system further includes a compressor in fluid communication with the refrigerant loop. The compressor has an electric motor including a rotor and a stator, a housing enclosing the electric motor, a stator cooling passageway provided within the housing, and a rotor cooling passageway provided within the housing. The rotor cooling passageway is independent of the stator cooling passageway.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1:
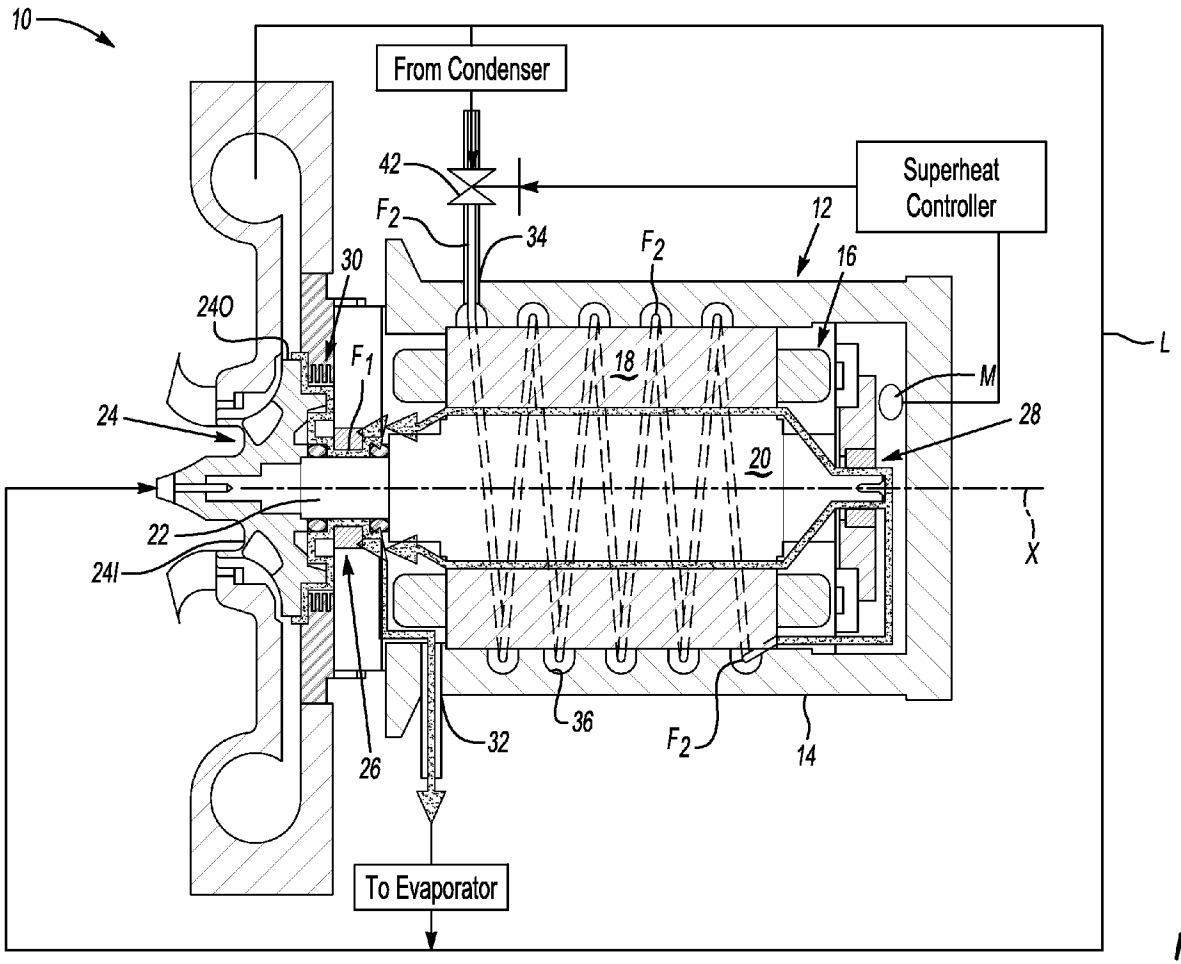
Fig-1 PRIOR ART
FIG. 1 is a highly schematic view of a prior art refrigeration system.

FIG. 1 schematically illustrates an example refrigeration system 10. In the example, the refrigeration system 10 includes a centrifugal refrigerant compressor 12 for circulating a refrigerant. The compressor 12 includes a housing 14 within which an electric motor 16 is arranged. The electric motor 16 includes a stator 18 arranged radially outside of a rotor 20. The rotor 20 is connected to a rotor shaft 22, which rotates to drive an impeller 24 about an axis X to compress refrigerant. Although only one impeller 24 is shown, this disclosure may be used in compressors having more than one impeller. The rotor shaft 22 is rotatably supported by first and second bearing assemblies 26, 28.

In this example, the compressor 12 is in fluid communication with a refrigeration loop L. While not illustrated, refrigeration loops, such as the refrigeration loop L, are known to include a condenser, an evaporator, and an expansion device. In some known examples, the refrigeration loop L circulates refrigerant to a load, such as a chiller.

In this example, as refrigerant enters an inlet end 241 of the impeller 24 and is expelled radially outward from an outlet end 240 thereof, a flow F1 is leaked over the labyrinth seal 30 (e.g., in particular, the flow F1 leaks axially between the radial clearance between the rotor shaft 22 and the labyrinth seal 30), and is directed downstream toward the first bearing assembly 26. The flow F1 is then directed out an outlet 32 of the housing 14 at a point upstream of the motor 16. The outlet 32 of the housing 14 is directed to the evaporator of the refrigerant loop L.

With further reference to FIG. 1, the electric motor 16 is cooled by tapping a cooling flow F2 of refrigerant from the refrigerant loop L, and directing it into an inlet 34 in the housing 14. In some examples, an expansion device 42 is provided upstream of the inlet 34. The expansion device 42 may either be a fixed orifice or a controlled valve. Upstream of the expansion device 42, the cooling flow F2 is initially in sub-cooled liquid state, and downstream thereof the cooling flow F2 is a liquid-vapor mixture. The cooling flow F2 proceeds to circulate about the stator 18 by way of a circumferential passageway 36. In one example, the outer radial boundary of the circumferential passageway 36 is provided in part by a helical channel formed in an inner wall of the housing 14. In this example, an outer surface of the stator 18 provides an inner radial boundary for the circumferential passageway 36. While a helical channel is illustrated, other types of circumferential passageways 36 come within the scope of this disclosure. As used herein, the term circumferential passageway refers to a passageway provided adjacent the outer circumference of the stator 18.

Downstream of the stator 18, the cooling flow F2 is directed toward the second bearing assembly 28, and passes axially between the rotor 20 and the stator 18 to cool the rotor. Then, the cooling flow F2 intermixes with the flow F1 at a point adjacent the first bearing assembly 26, flows to the outlet 32, and ultimately is directed to the evaporator of the refrigerant loop L.

Again, in this example, the cooling flow F2 is provided into the housing 14 initially as a liquid-vapor mixture. However, the cooling flow F2 is required to be in a gaseous state when passing between the rotor 20 and the stator 18. Thus, in the example of FIG. 1, the cooling flow F2 is continually monitored, at M, by a superheat controller for at least one of pressure and temperature, to ensure that the cooling flow F2 has changed phase into a gaseous state (e.g., by virtue of being heated by the stator 18) before cooling the rotor 20. One or more conditions of the refrigeration system 12 may have to be adjusted, depending on the measured conditions of the cooling flow F2, at M, to ensure that the appropriate phase change has occurred in the cooling flow F2.

Figure 2:
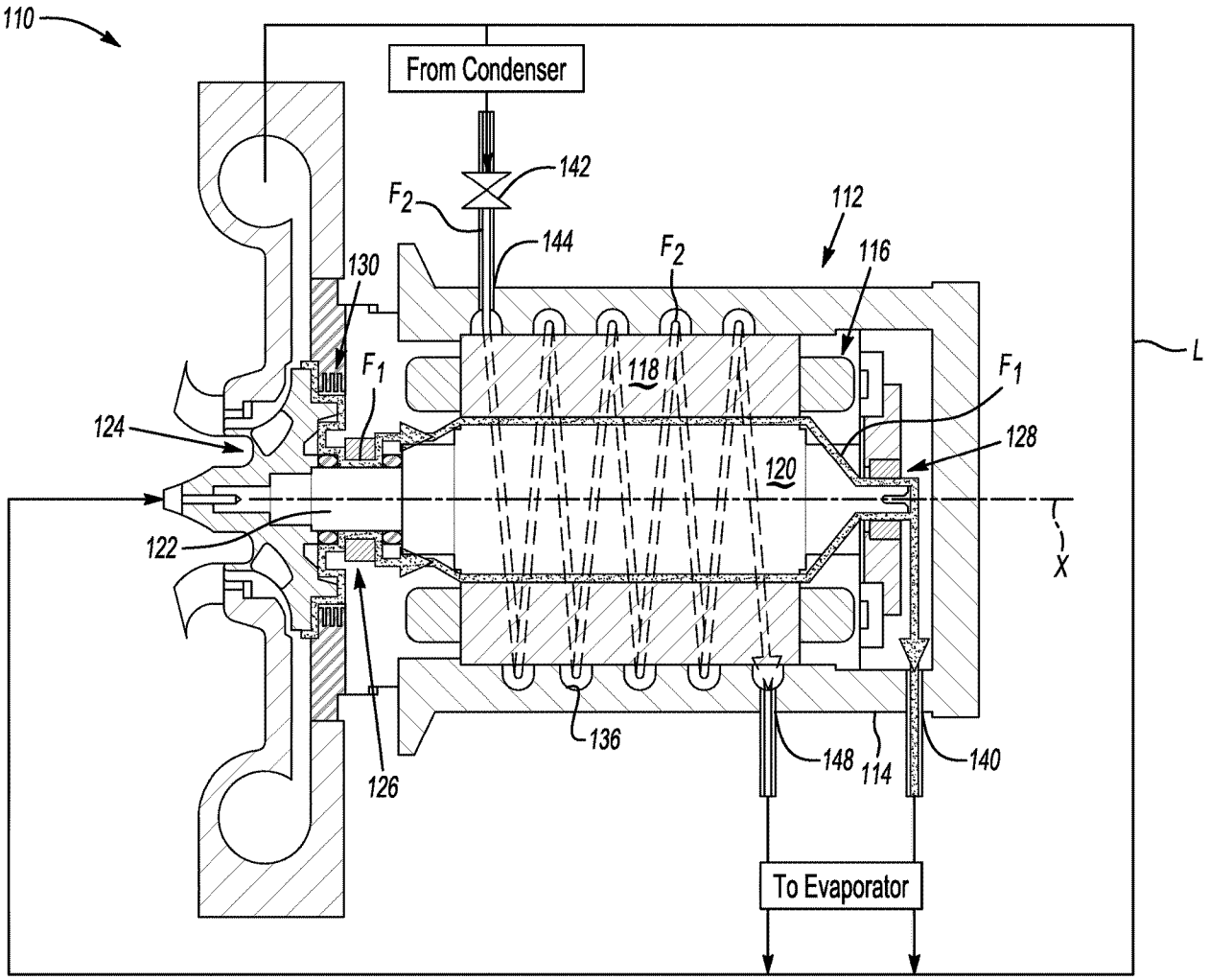
FIG. 2 is a highly schematic view of a refrigeration system according to this disclosure.

FIG. 2 illustrates an example refrigeration system 110 according to this disclosure. To the extent not otherwise described or shown, the reference numerals in FIG. 2 generally correspond to those of FIG. 1, with like parts having reference numerals prepended with a "1." Unlike the compressor 12, however, the compressor 112 is arranged to have independent rotor and stator cooling passageways, as will be discussed below.

In this example, a rotor cooling passageway is provided from a flow F1 leaked over the labyrinth seal 130. As used herein, the term rotor cooling passageway refers to the passageway providing fluid to cool the rotor 120. As one skilled in this art would appreciate, the rotor cooling passageway also provides cooling to the radially inner surface of the stator 118, however. As refrigerant is expelled radially outwardly from the impeller 124, a flow F1 is leaked over the labyrinth seal 130 between a radial clearance between the rotor shaft 122 and the labyrinth seal 130. The flow F1 then passes downstream to the first bearing assembly 126, and then between a radially inner surface of the stator 118 and a radially outer surface of the rotor 120. Next, the flow F1 passes downstream to the second bearing assembly 128, and then to a rotor cooling outlet 140 of the housing 114 provided downstream of the motor 116. The flow F1 is ultimately directed to the evaporator of the refrigerant loop L, in one example.

Regarding the stator cooling passageway, a flow of fluid F2 is tapped from the refrigerant loop L, and may optionally be expanded by an expansion device 142 before entering a stator cooling inlet 144 of the housing 114. Downstream of the stator cooling inlet 144, the fluid F2 circulates radially around the stator 118 by way of a circumferential passageway 136. After circulating about the stator 118, the fluid F2 is directed to a stator cooling outlet 148, and ultimately back to the refrigerant loop L, in this example to the evaporator. Accordingly, the rotor and stator cooling passageways are independent of one another, as the fluid cooling the stator 118 is not also used to cool the rotor 120. In other words, the stator 118 and the rotor 120 are cooled in parallel, and not in series like in the prior art system of FIG. 1.

The impeller 124 compresses refrigerant in a gaseous state. The flow F1 is thus initially in a gaseous state, and remains in a gaseous state as it flows within the rotor cooling passageway to cool the rotor 120. Accordingly, there is no need to continually monitor the fluid cooling the rotor for a phase change, and thus the superheat controller of FIG. 1 is not required. Thus, having independent rotor and stator cooling passageways increases the reliability and safety of the system, while eliminating the need to continually monitor the fluid cooling the rotor.

Figure 3:
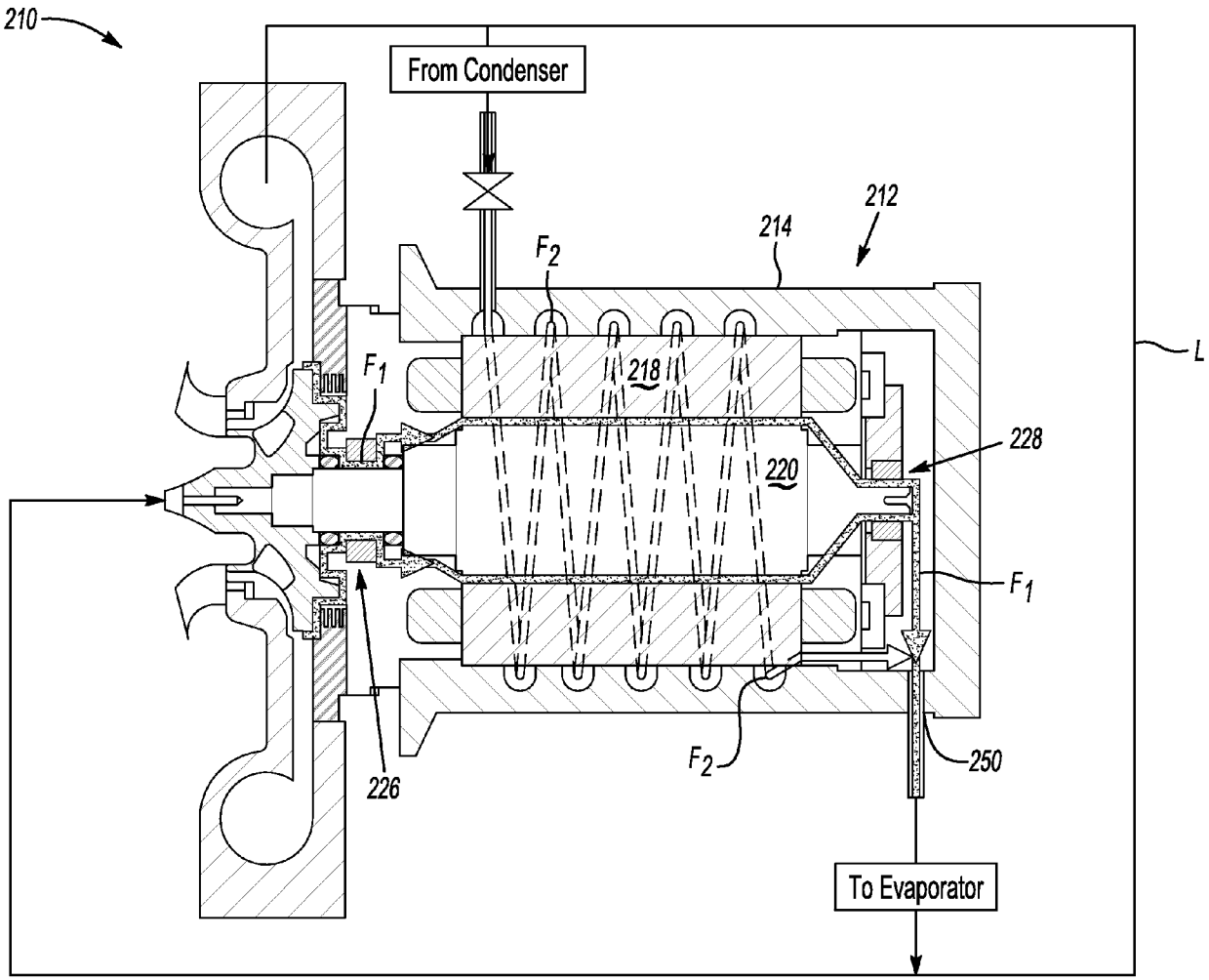
FIG. 3 is a highly schematic view of another refrigeration system according to this disclosure.

FIG. 3 illustrates another example refrigeration system 210 according to this disclosure. To the extent not otherwise described or shown, the reference numerals in FIG. 3 correspond with like parts in FIG. 2, although the reference numerals are prepended with a "2" instead of a "1."

In FIG. 3, the housing 214 includes a single outlet 250 for directing both the flow F1 and the cooling flow F2 back to the evaporator of the refrigerant loop L. While in this example the flow F1 and the cooling flow F2 are intermixed inside the housing 214, this intermixing occurs downstream of the motor 216. Thus, the rotor and stator cooling passageways are still independent of one another, in that fluid cooling the stator 218 (e.g., the cooling flow F2) is not also used to cool the rotor 220 (e.g., which is cooled with the flow F1).

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A centrifugal compressor for a refrigeration system, comprising:

an electric motor including a rotor and a stator;

a housing enclosing the electric motor;

a stator cooling passageway provided within the housing; and a rotor cooling passageway provided within the housing, the rotor cooling passageway independent of the stator cooling passageway, wherein the stator cooling passageway and housing are arranged such that all fluid exiting the stator cooling passageway flows to an evaporator of the refrigeration system without first flowing through the rotor cooling passageway;

wherein the electric motor is configured to rotationally drive an impeller via a shaft, the impeller provided at an axial inlet of the housing, wherein fluid being compressed by the impeller is substantially separated from the electric motor by a labyrinth seal;

wherein the rotor cooling passageway is provided in part between the rotor and the stator, the rotor cooling passageway provided with a flow of fluid leaked over the labyrinth seal.

2. The centrifugal compressor as recited in claim 1, wherein the housing includes a rotor cooling outlet in communication with the rotor cooling passageway.

3. The centrifugal compressor as recited in claim 2, wherein the rotor cooling passageway is arranged such that the fluid within the rotor cooling passageway flows to the rotor cooling outlet without intermixing with fluid flowing through the stator cooling passageway.

4. The centrifugal compressor as recited in claim 3, including first and second bearing assemblies supporting the shaft, the first bearing assembly provided downstream of the labyrinth seal and upstream of the motor, and the second bearing assembly provided downstream of the motor and upstream of the rotor cooling outlet, fluid within the rotor cooling passageway flowing axially from the labyrinth seal, to the first bearing assembly, to the motor, to the second bearing assembly, and then to the rotor cooling outlet.

5. The centrifugal compressor as recited in claim 1, wherein a portion of the stator cooling passageway is provided in part by a circumferential passageway provided around the stator.

6. The centrifugal compressor as recited in claim 5, wherein the housing includes a helical channel providing a portion of the circumferential passageway, and an outer surface of the stator provides a radially inner boundary for the circumferential passageway.

7. The centrifugal compressor as recited in claim 6, wherein the housing includes a stator cooling inlet and a stator cooling outlet in communication with the circumferential passageway.

8. The centrifugal compressor as recited in claim 7, wherein fluid within the stator cooling passageway flows from the stator cooling inlet to the stator cooling outlet without intermixing with fluid flowing within the rotor cooling passageway.

9. The centrifugal compressor as recited in claim 8, wherein the stator cooling passageway consists of the stator cooling inlet, the circumferential passageway, and the stator cooling outlet.

10. The centrifugal compressor as recited in claim 8, including an expansion device upstream of the stator cooling inlet for expanding a fluid before being circulated within the stator cooling passageway.

11. A centrifugal compressor for a refrigeration system, comprising:

an impeller;

an electric motor including a rotor and a stator, the electric motor configured to rotationally drive the impeller via a shaft, the impeller separated from the electric motor by a seal;

a housing enclosing the electric motor;

a rotor cooling passageway provided within the housing, the rotor cooling passageway configured to provide a flow of fluid to cool the rotor, wherein the rotor cooling passageway is provided with a flow of fluid leaked over the seal, wherein the seal is a labyrinth seal; and a stator cooling passageway provided within the housing, the stator cooling passageway independent of the rotor cooling passageway, wherein the stator cooling passageway and housing are arranged such that all fluid exiting the stator cooling passageway flows to an evaporator of the refrigeration system without first flowing through the rotor cooling passageway.

12. The centrifugal compressor as recited in claim 11, wherein the rotor cooling passageway is provided in part between the rotor and the stator.

13. The centrifugal compressor as recited in claim 12, wherein the housing includes a rotor cooling outlet, the fluid within the rotor cooling passageway flowing from the seal to the rotor cooling outlet.

14. A refrigeration system comprising:

a refrigerant loop including a condenser, an evaporator, and an expansion device;

a compressor in fluid communication with the refrigerant loop, the compressor having an electric motor including a rotor and a stator, a housing enclosing the electric motor, a stator cooling passageway provided within the housing, and a rotor cooling passageway provided within the housing, the rotor cooling passageway independent of the stator cooling passageway, wherein the stator cooling passageway and housing are arranged such that all fluid exiting the stator cooling passageway flows to the evaporator of the refrigeration system without first flowing through the rotor cooling passageway;

wherein the electric motor is configured to rotationally drive an impeller via a shaft, the impeller provided at an axial inlet of the housing, the impeller separated from the electric motor by a labyrinth seal;

wherein the rotor cooling passageway is provided with a flow of fluid leaked over the labyrinth seal.

15. The refrigeration system as recited in claim 14, wherein fluid within the rotor cooling passageway is configured to flow therein without intermixing with fluid flowing through the stator cooling passageway.

* * * * *